US005140800A

United States Patent [19]

Martin et al.

[11] Patent Number: 5,140,800

[45] Date of Patent: Aug. 25, 1992

[54] METHOD AND APPARATUS FOR SEVERING PACKAGING MATERIAL BETWEEN SUCCESSIVE WRAPPED LOADS

[75] Inventors: Stuart Martin, Corydon; Curtis Martin, New Albany, both of Ind.; Bill Bird, Louisville, Ky.; John Fain, Louisville, Ky.; Phil Moore, Mt. Washington, Ky.

[73] Assignee: Lantech, Inc., Louisville, Ky.

[21] Appl. No.: 665,115

[22] Filed: Mar. 6, 1991

[51] Int. Cl.[5] ..... B65B 61/06

[52] U.S. Cl. ..... 53/441; 53/450; 53/547; 53/556; 83/62.1; 493/33

[58] Field of Search ..... 53/548, 547, 550, 450, 53/461, 441, 556, 389.3; 83/62.1, 62; 493/32, 33

[56] References Cited

U.S. PATENT DOCUMENTS

| | | | |
|---|---|---|---|
| 3,020,687 | 2/1962 | Joa | 53/450 X |
| 3,626,797 | 12/1971 | Calvert et al. | 83/62 |
| 3,800,498 | 4/1974 | Suzuki | 83/62.1 X |
| 4,050,220 | 9/1977 | Lancaster et al. | 53/198 |
| 4,738,079 | 4/1988 | Lancaster et al. | 53/450 |

*Primary Examiner*—James F. Coan

*Attorney, Agent, or Firm*—Finnegan, Henderson, Farabow, Garrett & Dunner

[57] ABSTRACT

A method and apparatus is provided for severing packaging material which extends between successive wrapped loads during a continuous packaging process. A conveyor assembly conveys the wrapped loads along a load path in a conveying direction. The conveyor assembly includes a first conveyor portion having a discharge area and a second conveyor portion having a receiving area downstream and a step down from the discharge area of the first conveyor portion. A severing assembly includes a severing element located above the second conveyor portion for severing the packaging material between loads. A pivoting breakaway mechanism permits the severing element to pivot in the conveying direction. An escapement mechanism, responsive to load sensors, transports the severing element to a position spaced from the load path when the severing element encounters a load.

33 Claims, 9 Drawing Sheets

METHOD AND APPARATUS FOR SEVERING PACKAGING MATERIAL BETWEEN SUCCESSIVE WRAPPED LOADS

BACKGROUND OF THE INVENTION

The present invention relates to a method and apparatus for severing packaging material, and more particularly, for severing packaging material which extends between successive wrapped loads during a continuous wrapping process.

Stretch wrapping is a method of wrapping loads with a tensioned web of packaging material such as stretch wrap film. An example of a method and apparatus for stretch wrapping is disclosed in U.S. Pat. No. 4,317,322 to Lancaster et al., assigned to Lantech, Inc., and is incorporated herein by reference.

Recently, developments in stretch wrapping have focused on methods and apparatus for continuously wrapping a series of loads in an uninterrupted manner. Such continuous wrapping involves conveying a series of loads through a wrapping area in which the loads are spirally wrapped with stretch wrap film. As a result, the series of loads become encased with a continuous tube of stretch wrap film. A severing bar, positioned downstream of the wrapping station, is passed between successive wrapped loads. The severing bar severs the tube of plastic material between successive wrapped loads and separates the wrapped loads.

As it has become possible to wrap at higher speeds, the conveying speed of the wrapped loads has also increased. To prevent the severing bar from striking the rapidly moving loads, it has become necessary to translate the severing bar in the conveying direction along with the loads while passing it between successive wrapped loads.

To reliably sever the packaging material on a prolonged and repeated basis, a heating element is incorporated in the severing bar to heat the severing bar so that the packaging material is melted or substantially weakened upon coming in contact with the severing bar. The heating element in the severing bar is supplied with electricity by an electrical conductor which is connected to a power source.

The complexity of the severing mechanism has substantially increased along with the need for high precision and the possibility of malfunctions. With such mechanisms, a malfunction could easily damage the severing mechanism, cause extensive delays during downtime for repairs, and cause fires if a heated severing element remains in prolonged contact with a load which is being wrapped.

An example of a method and apparatus for severing packaging material between successive wrapped loads during a continuous wrapping process is disclosed in U.S. Pat. No. 4,738,079 to Lancaster et al., assigned to Lantech, Inc., which is incorporated herein by reference. In the arrangement disclosed in the drawing of that patent, the load is transported along an even horizontal path by a series of conveyor belts. In the area of the severing mechanism, the conveyor belt follows a V shaped path below the horizontal load path to allow the severing bar to pass below the load path to ensure having the severing bar cut through the entire film tube including the lower portion of the film tube.

This design and other designs creating a gap in the conveyor bed were found to have drawbacks. For example, it was not completely satisfactory when used with a severing element which moved in a pattern which included movement in the conveying direction during cutting. It also was not completely satisfactory in avoiding and resolving jams which occurred when the severing element was unexpectedly and undesirably contacted by the load.

Using a flat conveyor belt surface at the severing station also was not completely satisfactory because there were times when the severing element would not cut the bottom of the film tube.

Accordingly, it is an object of the present invention to provide a method and apparatus for severing packaging material in which the severing element reliably cuts through the complete film tube and which does not jam or prevent the series of wrapped loads to be reliably conveyed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects and in accordance with the purposes of the invention as embodied and broadly described herein, there is provided an apparatus for severing packaging material which extends between successive wrapped loads during a continuous packaging process. The apparatus includes a conveyor assembly for conveying the wrapped loads along a load path in a conveying direction. The conveyor assembly includes a first conveyor portion having a discharge area and a second conveyor portion having a receiving area downstream and a step down from the discharge area of the first conveyor portion. The apparatus also includes a severing assembly. The severing assembly includes a severing element located above the second conveyor portion and means for moving the severing element between a load positioned at an upper level in the discharge area of the first conveyor portion and a load positioned at a lower level in the receiving area of the second conveyor portion for severing the packaging material between the loads. A breakaway mechanism permits the severing element to be displaced by a load in the conveying direction if the severing element is encountered by a load, and permits the severing element to be reset for subsequent operation. Load sensors detect if the severing element encounters a load, and an escapement is responsive to the load sensors for transporting the severing element to a position spaced from the load path when the severing element encounters a load.

BRIEF DESCRIPTION OF THE DRAWINGS

The accompanying drawings which are incorporated in and constitute a part of the specification, illustrate a presently preferred embodiment of the invention and, together with the general description given above and the detailed description of the preferred embodiments given below, serve to explain the principles of the invention.

DESCRIPTION OF THE PREFERRED EMBODIMENTS

Reference will now be made in detail to the present preferred embodiments of the invention as illustrated in the accompanying drawings.

Figure 1:
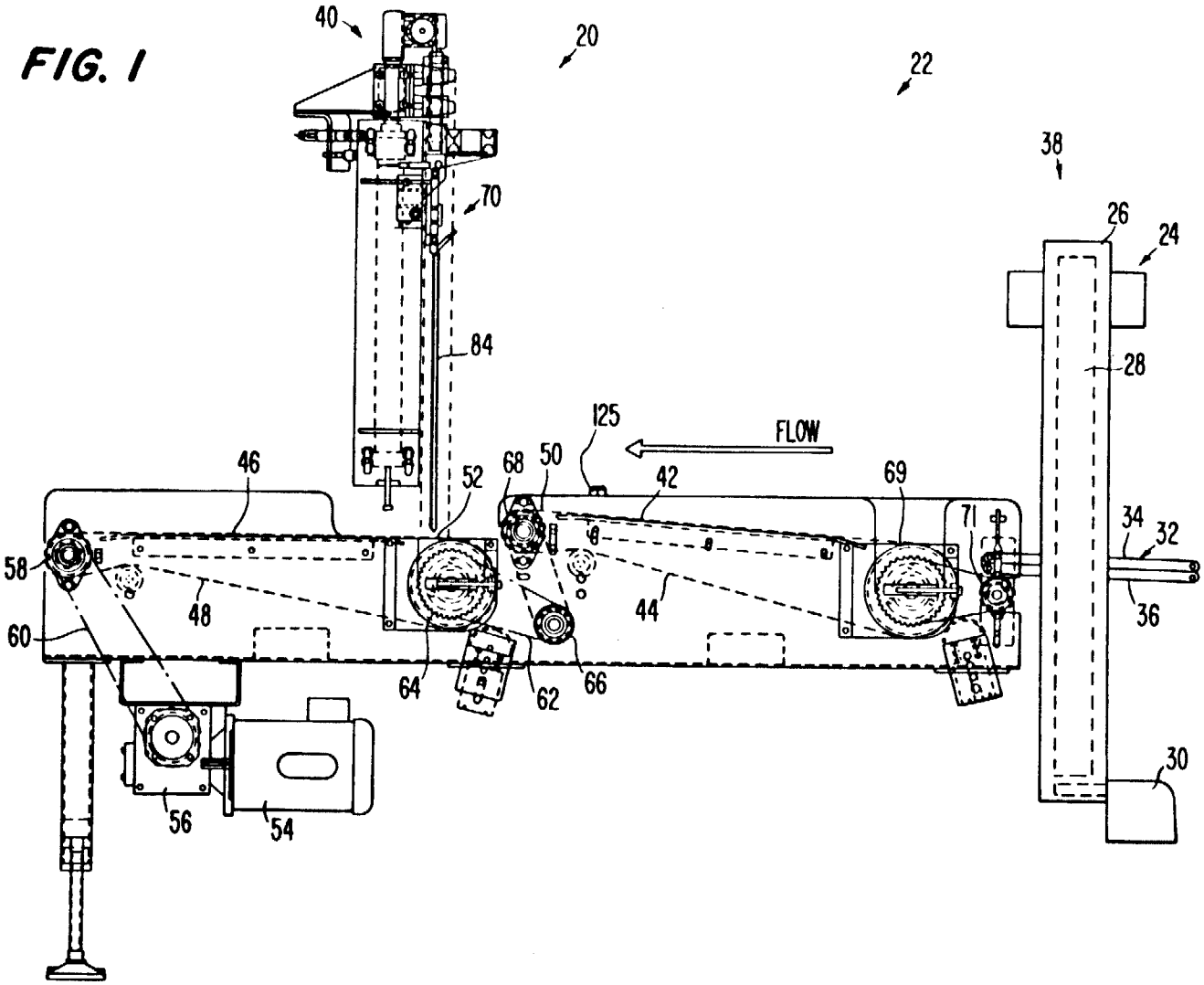
FIG. 1 is a side elevation view of an apparatus for severing packaging material which incorporates the teachings of the present invention.

In accordance with the present invention, there is provided an apparatus for severing packaging material which extends between successive wrapped loads during a continuing packaging process. As shown in FIG. 1, the severing apparatus is part of a stretch wrapping apparatus 22. The stretch wrapping apparatus includes a stretch wrap dispenser 24 for dispensing a web of stretch wrap packaging material on a load, and means for providing relative rotation between the stretch wrap dispenser 24 and a series of loads to wrap the stretch wrap packaging material around and between the series of loads.

Stretch wrap dispenser 24 preferably includes a support for a roll of stretch wrap packaging material, and feed rollers which can be driven to stretch the web between a slower moving upstream roller and a faster moving downstream roller in accordance with the arrangement shown in U.S. Pat. Nos. 4,302,920 or 4,418,510 to Lancaster et al., assigned to Lantech, Inc. which are incorporated herein by reference.

The means for providing relative rotation between the stretch wrap dispenser and the series of loads includes a stationary ring 26, a rotatable ring 28 connected to stretch wrap dispenser 24 and ring drive motor 30. Rotatable ring 28 is mounted on stationary ring 26 and driven by ring drive motor 30 to rotate stretch wrap dispenser 24 in a circle around a series of loads which pass through the center of the ring and are wrapped with stretch wrap packaging material as they are conveyed with a wrapping conveyor assembly 32 in the manner shown in U.S. Pat. Nos. 4,317,322 and 4,738,079.

Wrapping conveyor assembly 32 includes an endless belt 34 having an exposed horizontal surface for supporting and conveying a series of loads in a downstream direction (to the left in FIG. 1). In addition, conveyor 32 includes a belt 36 which receives and transports packaging material in a downstream direction during wrapping.

Although the wrapping station 38 is shown to include one rotating ring 28, the wrapping station 38 can also include a second rotating ring which encircles the wrapping conveyor assembly 32 and the loads. If such a ring is used, it preferably rotates in a direction opposite the direction of the first rotatable ring 28 to spirally wrap stretch wrap packaging around the wrapping conveyor assembly and the loads in the opposite helical direction of the first ring. An example of such a dual ring system is shown in U.S. Pat. No. 4,953,336 to Lancaster, et al., assigned to Lantech, Inc. which is incorporated herein by reference.

After passing the wrapping station 38, wrapped loads proceed off the downstream end of the wrapping conveyor assembly 32. The wrapped material recovers from the downstream end of the wrapping conveyor assembly 32 onto the wrapped loads and the wrapped loads continue to be conveyed downstream through a severing station 40.

Other wrapping operations, such as those that provide shrink wrap or a continuous tube of materials, may be used as an alternative to stretch wrap packaging techniques.

In accordance with the present invention, the apparatus for severing packaging material includes a conveyor assembly which conveys the wrapped loads along a load path in a conveying direction. The conveyor assembly includes a first conveyor portion having a discharge area and second conveyor portion having a receiving area downstream and a step down from the discharge area of the first conveyor portion.

As shown in FIG. 1, the first conveyor portion 42 is the load engaging portion of a first endless loop conveyor 44 and the second conveyor portion 46 is the load engaging portion of a second endless loop conveyor 48. First conveyor portion 42 forms a first planar surface and second conveyor portion 46 forms a second planar surface. First conveyor portion 42 includes a discharge area 50 and the second conveyor portion 46 has a receiving area 52 downstream and a step down from the discharge area 50 of first conveyor portion 42. The vertical distance between the discharge area of the first conveyor portion and the receiving area of the second conveyor portion is preferably one to two inches.

First and second endless loop conveyors are driven by severing station conveyor motor 54. Motor 54 drives gear reducer 56, which drives downstream roller 58 of second endless loop conveyor 48. Chain 62 is driven by upstream roller 64 of second endless loop conveyor 48 which in turn drives idler 66, in turn driving downstream roller 68 of first endless loop conveyor 44. Upstream roller 69 of first endless loop conveyor drives roller 71 which supports wrapping conveyor or assembly 32. The drive assembly allows for easily changing sprockets to create differential speeds between these components.

The gear ratio of the drive between upstream roller 64 of second endless loop conveyor 48 and downstream roller 68 of first endless loop conveyor 44 causes the first conveyor portion 42 to convey the wrapped loads at a slower rate than the second conveyor portion 46.

This applies tension to the packaging material which extends between successive loads.

A differential speed between roller 71 and a first conveyor portion 42 of the severing station affects how fast the film is fed off the bottom of the wrapping conveyor assembly 32 onto the first conveyor portion 42. Having the film come off a little faster aids in the recovery of the film at the bottom of the film tube and can improve the cut results of the severing operation.

The belts which form the first conveyor portion 44 and the second conveyor portion 46 have a surface which is tacky when it contacts the polyethylene stretch film on the wrapped loads. Such belts include those made by Sparks Belting Company having two plies of monofilament polyester with a top side of 0.079 inches grey polyvinyl chloride (PVC) with plasticizer. The use of such belts ensures a good "hold" on the packages adding to stability of product when the wrapped load is conveyed over the step between discharge area 50 and receiving area 52, and when the packaging material is severed.

Figure 1A:
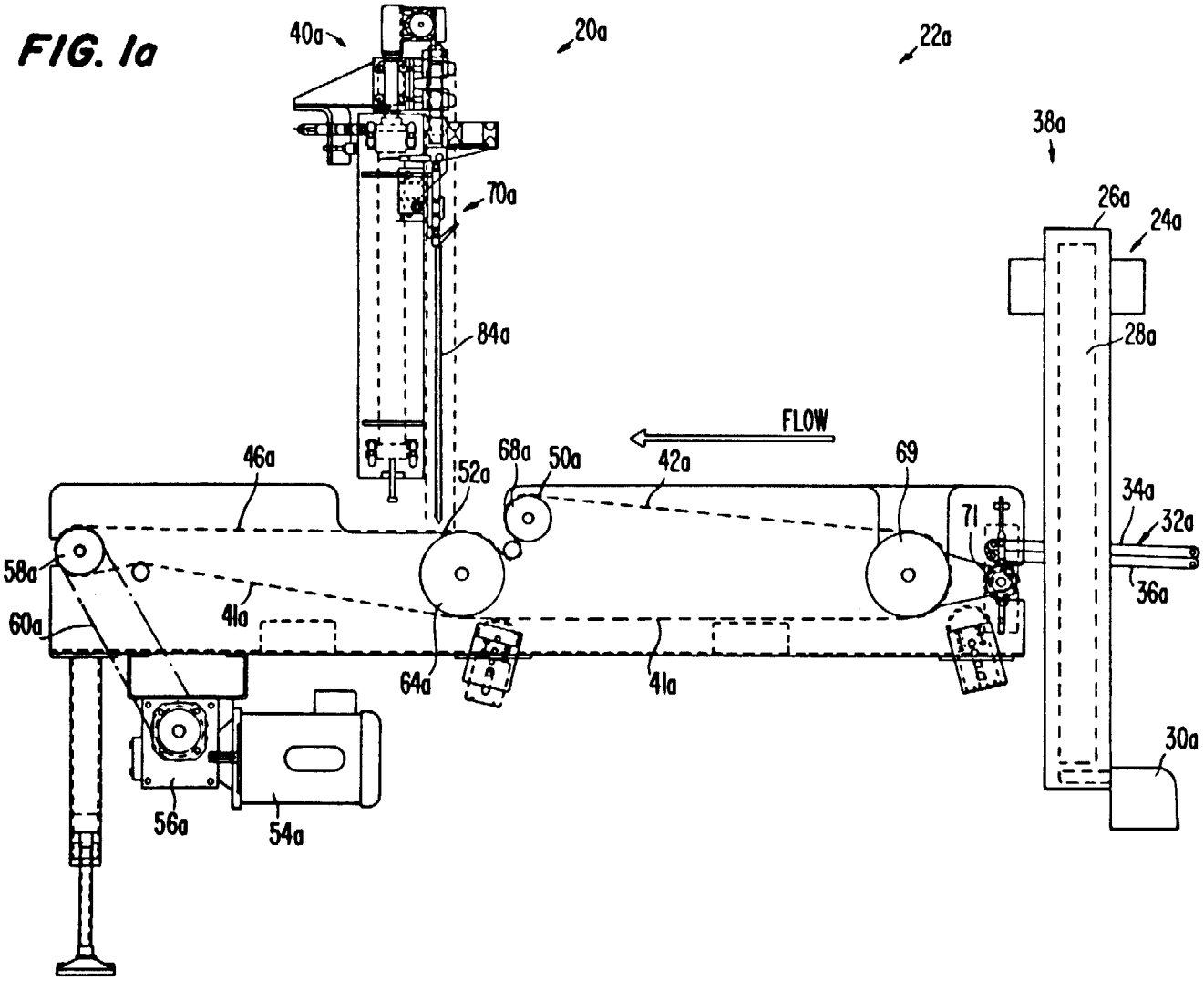
FIG. 1a is a side elevation view of an apparatus for severing packaging material which incorporates the teachings of the present invention.

While it is currently preferable, as shown in FIG. 1, that the discharge area of the first conveyor portion and the receiving area of the second conveyor portion are the load engaging portions of different endless loops, it is possible for them to also constitute different relative areas of the same endless loop as shown in FIG. 1*a*. As shown in FIG. 1*a*, first conveyor portion 42*a* with discharge area 50*a* and second conveyor portion 46*a* with receiving area 52*a* are different relative portions of a single endless loop conveyor 41*a*.

In accordance with the present invention, the apparatus also includes a severing assembly for severing the packaging material between the loads. The severing assembly includes a severing element located above the second conveyor portion and means for moving the severing element between a load positioned at an upper level in the discharge area of the first conveyor portion and a load positioned at a lower level in the receiving area of the second conveyor portion.

Figure 2:
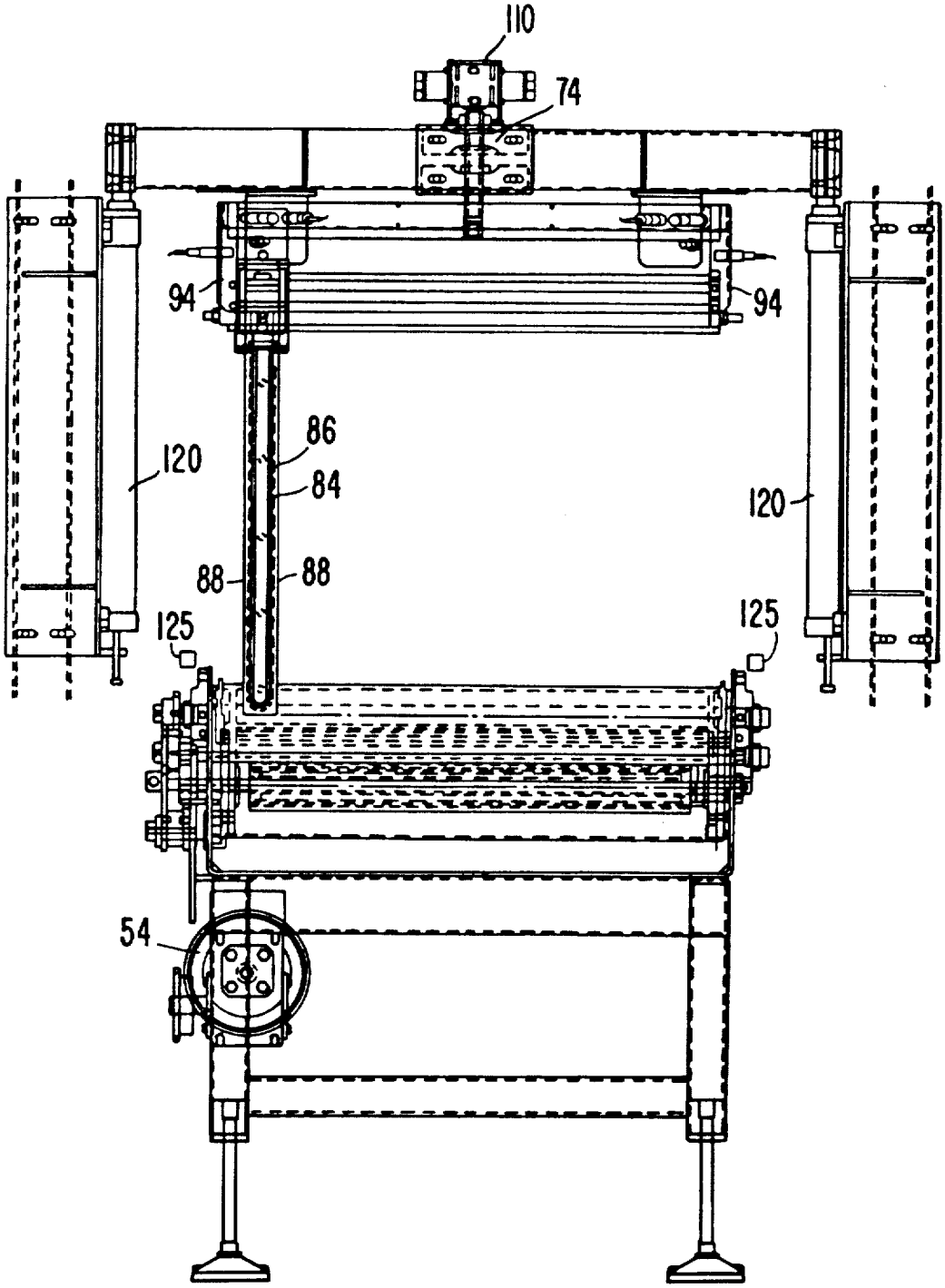
FIG. 2 is an end view of the apparatus shown in FIG. 1.
Figure 3:
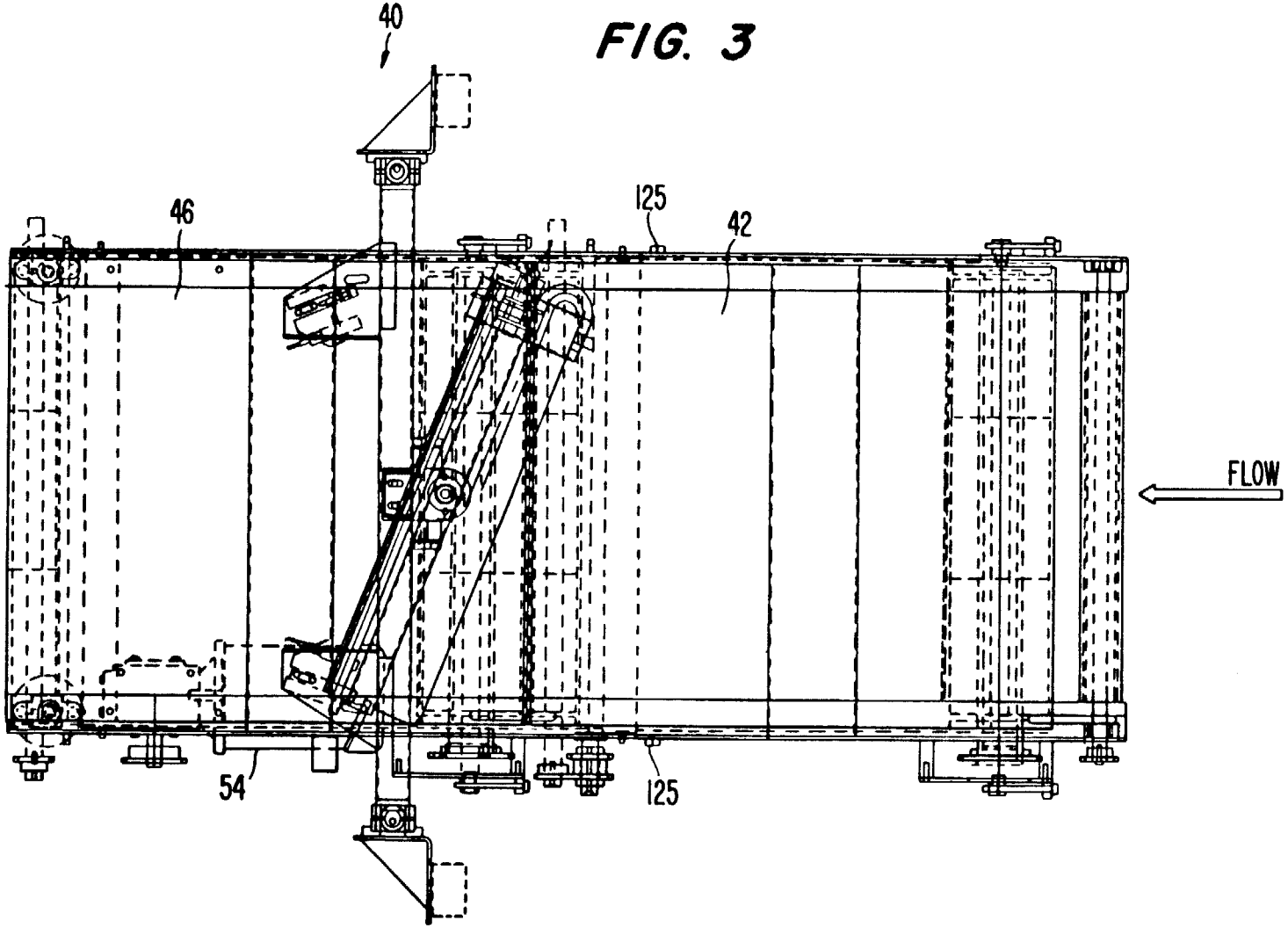
FIG. 3 is a top view of the apparatus shown in FIG. 1.
Figure 4:
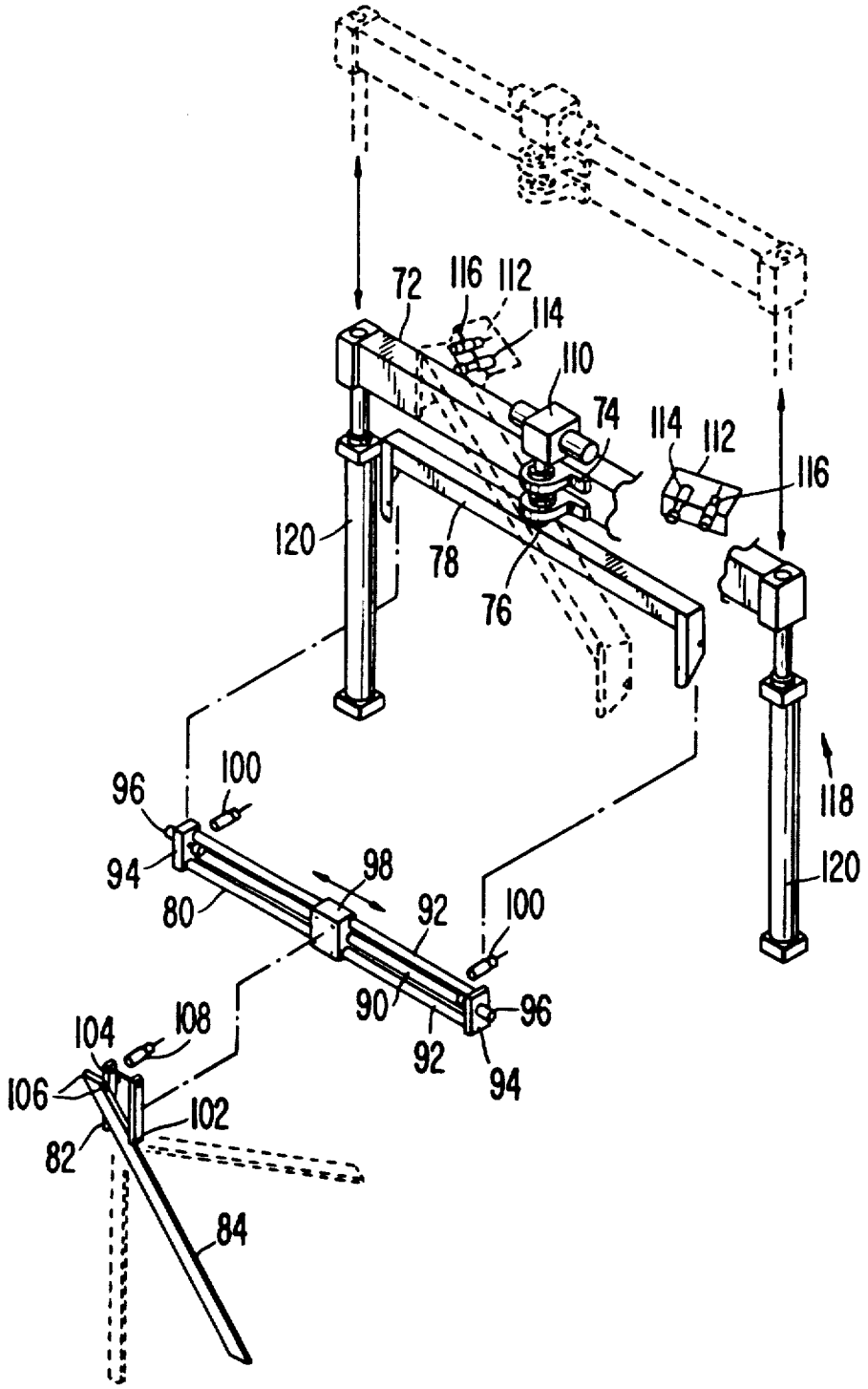
FIG. 4 is a partial perspective exploded view of the apparatus shown in FIG. 1.

As shown in FIG. 1, the severing assembly 70 is positioned at the severing station 40. As shown in FIG. 4, the severing assembly 70 includes a horizontal support beam 72, bearings 74 with vertical pivot axle 76, pivoting horizontal support bar 78 with pneumatic activated slide assembly 80, breakaway mechanism 82 and severing element 84. As shown in this embodiment, the severing element 84 is a bar extending lateral to the conveying direction which assumes a general vertical disposition. As shown in FIG. 2, severing element 84 includes a 1200 watt tubular heating element 86 which is looped around the interior periphery of a steel sheath having sharp leading edges 88.

The pneumatic activated slide assembly 80 constitutes a means for moving the severing element between a pair of successive loads and back across the load path between another pair of successive loads. The slide assembly 80 includes a central pneumatic actuator which is formed of a horizontal linear slide rodless cylinder 90 and two slide rods 92 extending between end plates 94 with shock absorbers 96. The rodless cylinder 90 drives support block 98 between end positions at which the support block 98 is sensed by proximity switches 100 which detect the position of support block 98.

Suitable proximity switches are inductive type proximity sensors which sense the proximity of metal such as the Quadronorm series made by Efector Inc. Other types of proximity switches or limit switches may be used, such as those which are mechanically actuated.

Breakaway mechanism 82 is mounted on support block 98 and includes a pivot 102 having a generally horizontal pivot axis, and ball detents 104 which engage depressions 106 in the sides of severing element 84. A proximity switch 108 senses breakaway of severing element 84 from its vertical position in ball detents 104, which is assumed during normal operations, to a pivoted position in which the severing element pivots in the conveying direction. The lead angle pivot mechanism maintains the severing element in the center of the gap between successive loads when traveling between successive loads. Although it is preferable for the breakaway mechanism to have a pivoting action, it is also possible for it to have a sliding action or other movement which allows the severing element to move in the conveying direction to prevent it from being damaged when being struck by a load.

During high speed operations it is necessary to move the severing element in the conveying direction during normal operation while it is traveling between successive loads. To do so, pivoting horizontal support bar 78 is oriented at an appropriate lead angle by pneumatic rotary actuator 110. After one cutting operation, horizontal support bar 78 is pivoted to provide a lead angle in the opposite direction.

Adjustable stop assemblies 112 ar used to preset the lead angle of pivoting horizontal support bar. Each stop assembly 112 includes a shock absorber 114 and a proximity switch 116.

According to the invention, the apparatus preferably includes an escapement 118 responsive to sensors for moving the severing assembly to transport the severing element 84 to a position away from the load path when the severing element 84 encounters a load. The escapement 118 preferably includes vertical pneumatic cylinders 120 which lift horizontal support beam 72 from a lower operating position shown in solid lines to an upper escape position shown in broken lines. The escapement 118 lifts the severing assembly vertically out of the product environment in jam conditions to reduce product damage and fire hazards and reduce damage to the equipment.

Figure 11:
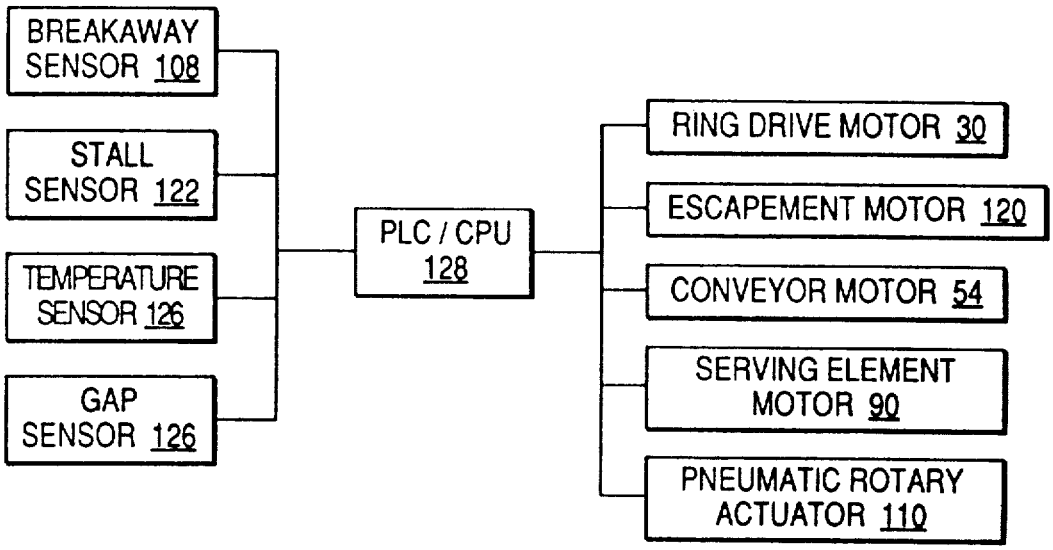
FIG. 11 is a block diagram of the control system used in the apparatus according to the teachings of the present invention.
Figure 12:
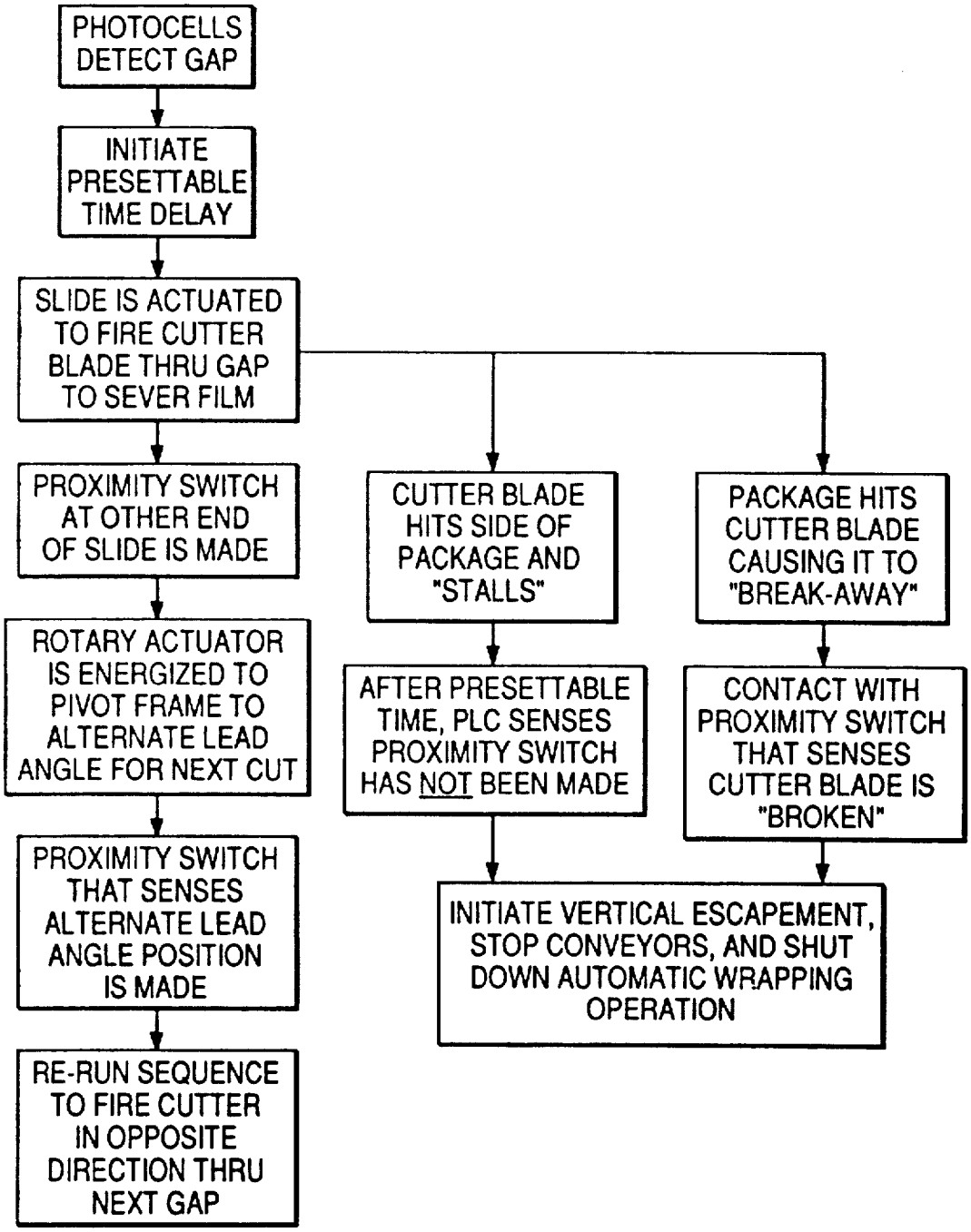
FIG. 12 is a block diagram of the sequencing of the control system shown in FIG. 11.

The control diagram in FIG. 11 shows that the motor 120 for pneumatic escapement 118 is actuated automatically when load sensors sense various conditions such as when the severing element 84 encounters the load. The sensing elements cause a control system to stop the conveyors 34, 36, 44, 48, the stretch wrap dispenser 24, and the severing element 84 by stopping the associated motors 30, 54, 90 and 120, in addition to initiating vertical escapement 118. Such sensing elements include proximity switch 108, stall sensor 122, and gap sensor 124. The control diagram shown in FIG. 12 illustrates the sequencing of operation.

Proximity switch 108 senses when severing element 84 pivots away from a normal vertical orientation. Stall sensor 122 senses when the severing element 84 stalls when encountering a side of a load facing transverse to the load path. A stall is sensed when the support block 98 is not sensed by a proximity switch 100 at an appropriate time. Gap sensor 124 preferably includes pairs of photocell units 125 which detect the gap between loads and prevents the severing element 84 from moving between the loads if the gap is less than the distance between the pair of photocells. Suitable photocell units 125 are the Allen-Bradley Series 7000. A temperature sensor 126 detects the temperature of the severing element 84 and permits the apparatus to operate only when the temperature is in a predetermined range, above 350° F. The operating temperature of the severing element is preferably around 650° F.

The incoming information from the sensors is received by a control system such as a central processing unit CPU having a programmable logic controller PLC, made up of a microprocessor 128. An example of a suitable microprocessor is Model No. SLC5/01 made by Allen-Bradley.

Figure 5:
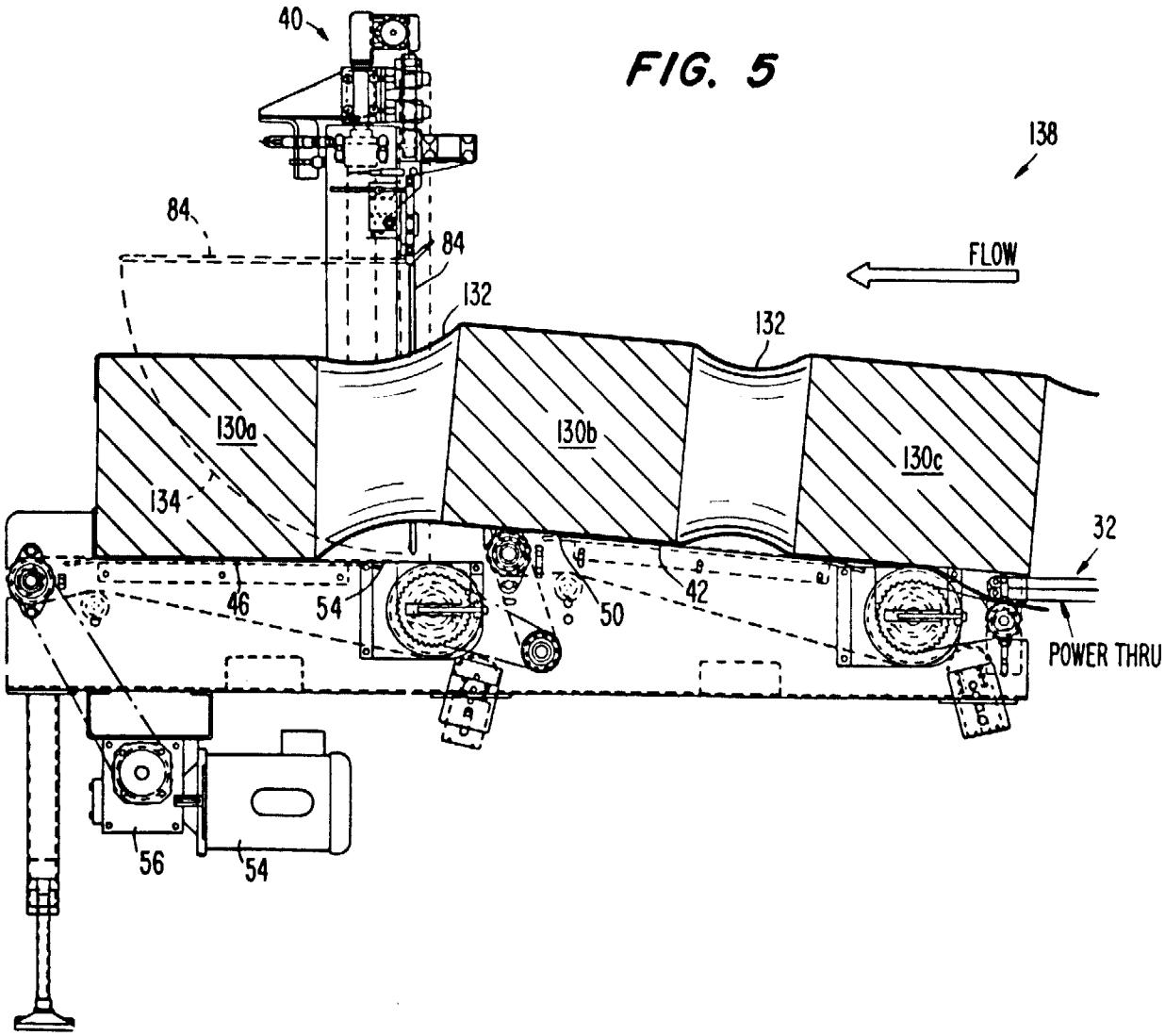
FIG. 5 is a side elevation view of the apparatus shown in FIG. 1 with a series of wrapped loads.

FIG. 5 shows the apparatus in operation. A series of loads 130*a*, 130*b*, and 130*c* progress from wrapping station 138 to the left onto first conveyor portion 42 with a film tube of spirally wrapped stretch film extending over and between successive loads. When a load comes to the first conveyor portion discharge area 50 it steps down to the second conveyor portion receiving area 54 with film tube 132 extending between loads 130*a* and 130*b*. Severing element 84 travels between the pair of successive loads 130*a* and 130*b* below the discharge area 50 of first conveyor portion 42 in the receiving area 54 of second conveyor portion 46. The film tube snaps back against the load after being cut as shown by the portion on the left side of load 130*a*.

In the normal severing operation, there is space under the film tube at the severing station 40. The severing element 84 protrudes below the film tube but is free and clear to swing away downstream along arc 134 to a displaced position shown in broken lines if hit by a load. The use of a step down conveyor arrangement provides an L shaped valley which is open on the downstream side, providing clearance for the severing element in the downstream direction during breakaway. The drive linkage for the conveyors which causes the second endless loop conveyor to drive faster than the upstream first endless loop conveyor pulls the film tube taut, aiding the cutting operation performed by severing element 84.

The apparatus establishes and maintains a proper gap throughout the cutting operation through the use of conveyors which can be controllable driven at different speeds and through the use of the tacky belt. The apparatus also allows the severing element to operate throughout a range of lead angles, permits unobstructed breakaway pivot action of the severing element in a jam condition, and ensures complete cut of the film tube between packages even if the wrapping parameters have not been optimized.

Since the first conveyor portion discharge area 50 is positioned approximately one to two inches higher than the second conveyor portion receiving area 52, each pair of successive loads becomes staggered due to the vertical dimension which occurs for a brief time, during the conveyance of the product, when the leading load is on the lower conveyor portion 46 and the trailing load on the higher conveyor portion 42. The result is that the tube of packaging material between these loads is held partially above the lower conveyor portion 46 for a brief period of time. During this time, the severing element 84 is driven across the load path and through the tube of packaging material. The severing element 84 is positioned with its lower end just above the surface of the lower conveyor portion 46 and thus below the tube of packaging material to reliably cut completely through the tube of packaging material.

This stepped conveyor assembly, which has a step-down to a level portion, prevents interference with the breakaway pivot radius, and prevents interference with the full range of adjustment of the lead angle of the cutter.

Figure 6:
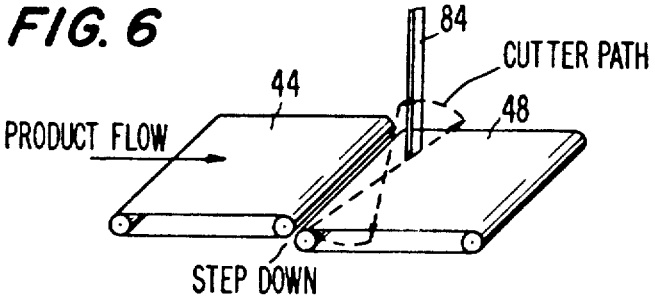
FIG. 6 is a partial perspective view of the apparatus shown in FIG. 1.

The path of the severing element in the embodiment shown in FIG. 1 is shown in FIG. 6. The severing element 84 leads the load as it cuts through the film tube. The severing element 84 travels across the conveyor 48 for a cut, moves upstream, then comes across the conveyor 48 in the opposite direction for the next cut and then moves upstream to repeat the process.

Figure 7:
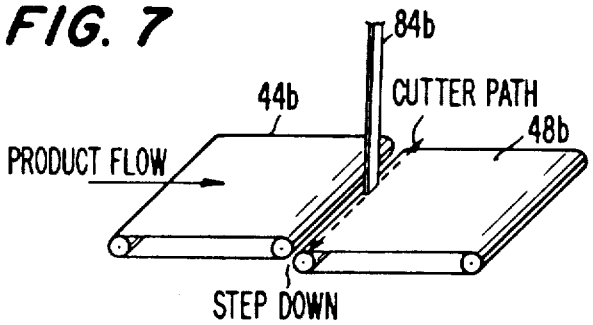
FIG. 7 is a partial perspective view of a second embodiment of the apparatus according to the teachings of the present invention.

FIG. 7 shows a second embodiment of the apparatus which shows a severing arrangement for slower conveying processes. It includes a severing element 84*b* that travels straight across the conveyor 48*b* to make one cut then back across for the next cut. As in the first embodiment, the severing element 84*b* is clear to breakaway downstream if hit by the load.

Figure 8:
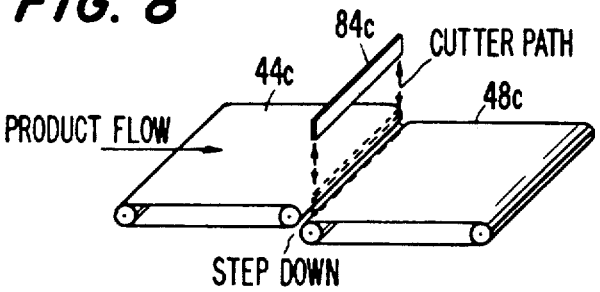
FIG. 8 is a partial perspective view of a third embodiment of the apparatus according to the teachings of the present invention.

FIG. 8 shows a third embodiment of the apparatus having a severing element 84*c* with a vertical motion that travels down through the film tube to cut and then returns to the up position to wait for the next gap to cut. The severing element 84*c* can breakaway downstream in this arrangement as well.

Figure 9:
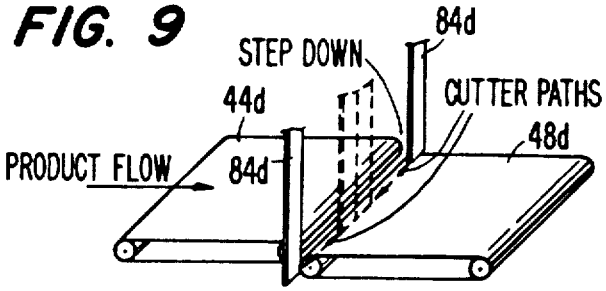
FIG. 9 is a partial perspective view of a fourth embodiment of the apparatus according to the teachings of the present invention.

FIG. 9 shows a fourth embodiment of the apparatus two severing elements 84*d*. Each severing element 84*d* travels to the center simultaneously to cut through the film tube and then withdraws and waits for the next gap. Both severing elements 84*d* are free to breakaway downstream if hit by the load.

Figure 10:
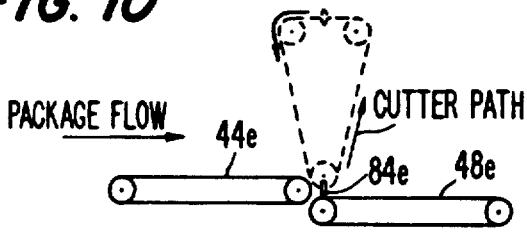
FIG. 10 is a partial side elevation view of a fifth embodiment of the apparatus according to the teachings of the present invention.

FIG. 10 shows a fifth embodiment of the apparatus in which the severing element 84*e* leads the package on the upstroke and downstroke while maintaining a vertical cutting movement.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of the general inventive concept as defined by the appended claims and their equivalents.

What is claimed is:

1. Apparatus for severing package material which extends between successive wrapped loads during a continuous packaging process comprising:

a conveyor assembly for conveying the wrapped loads along a load path in a conveying direction, the conveyor assembly including a first conveyor portion having a discharge area and a second conveyor portion having a receiving area downstream and a step down from the discharge area of the first conveyor portion; and a severing assembly including a severing element located above the second conveyor portion and means for moving the severing element along a severing path which passes directly over the second conveyor portion and between a load positioned at an upper level in the discharge area of the first conveyor portion and a load positioned at a lower level in the receiving area of the second conveyor portion for severing the packaging material between the loads.

2. The apparatus of claim 1 wherein the first conveyor portion is a load engaging portion of a first endless loop conveyor and the second conveyor portion is a load engaging portion of a second endless loop conveyor.

3. Apparatus for severing packaging material which extends between successive wrapped loads during a continuous packaging process comprising:

a conveying assembly for conveying the wrapped loads along a load path in a conveying direction;

a severing assembly including a severing element and means for moving the severing element between a pair of successive loads for severing the packaging material between the loads;

a breakaway mechanism for permitting the severing element to be displaced by a load in the conveying direction when the severing element is encountered by a load, and for permitting the severing element to be reset for subsequent operation.

4. The apparatus of claim 3 wherein the breakaway mechanism includes a pivot for permitting the severing element to pivot in the conveying direction.

5. The apparatus of claim 4 wherein the pivot has a generally horizontal pivot axis located above the load path.

6. Apparatus for severing packaging material which extends between successive wrapped loads during a continuous packaging process comprising:

a conveyor assembly for conveying the wrapped loads along a load path in a conveying direction, the conveyor assembly including a first conveyor portion having a discharge area and a second conveyor portion having a receiving area downstream and a step down from the discharge area of the first conveyor portion;

a severing assembly located above the second conveyor portion including a severing element and means for moving the severing element between a load positioned at an upper level in the discharge area of the first conveyor portion and a load positioned at a lower level in the receiving area of the second conveyor portion for severing the packaging material between the loads; and a breakaway mechanism for permitting the severing element to be displaced by a load in the conveying direction when the severing element is encountered by a load, and for permitting the severing element to be reset for subsequent operation.

7. The apparatus of claim 6 wherein the first conveyor portion is a load engaging portion of a first endless loop conveyor and the second conveyor portion is a load engaging portion of a second endless loop conveyor.

8. The apparatus of claim 6 wherein the breakaway mechanism includes a pivot for permitting the severing element to pivot in the conveying direction.

9. The apparatus of claim 8 wherein the pivot has a generally horizontal pivot axis located above the load path.

10. The apparatus of claim 1, 3 or 6 including a load sensor for detecting when the severing element encounters a load, and an escapement responsive to the load sensor for transporting the severing element to a position spaced from the load path when the severing element encounters a load.

11. The apparatus of claim 10 wherein the means for moving the severing element stalls when encountering a side of a load facing transverse to the load path and the load sensor senses this condition.

12. The apparatus of claim 10 wherein the load sensor senses when the severing element has been displaced by a side of a load facing the load path.

13. The apparatus of claim 1, 3 or 6 wherein the conveyor assembly includes means for transporting the first conveyor portion at a slower rate than the second conveyor portion to apply tension to the packaging material which extends between successive loads.

14. The apparatus of claim 1, 3 or 6 wherein the conveyor assembly includes a tacky surface which contacts the wrapped loads.

15. A stretch wrapping apparatus comprising:

a stretch wrap dispenser for dispensing a web of stretch wrap packaging material on a load and means for providing relative rotation between the stretch wrap dispenser and a series of loads to wrap the stretch wrap around and between the series of loads;

a conveyor assembly for conveying the wrapped loads along a load path in a conveying direction, the conveyor assembly including a first conveyor portion having a discharge area and a second conveyor portion having a receiving area downstream and a step down from the discharge area of the first conveyor portion; and a severing assembly including a severing element located above the second conveyor portion and means for moving the severing element along a severing path which passes directly over the second conveyor portion and between a load positioned at an upper level in the discharge area of the first conveyor portion and a load positioned at a lower level in the receiving area of the second conveyor portion for severing the packaging material between the loads.

16. The apparatus of claim 15 wherein the first conveyor portion is the load engaging portion of a first endless loop conveyor and the second conveyor portion is the load engaging portion of a second endless loop conveyor.

17. A stretch wrapping apparatus comprising:

a stretch wrap dispenser for dispensing a web of stretch wrap packaging material on a load and means for providing relative rotation between the stretch wrap dispenser and a series of loads to wrap the stretch wrap around and between the series of loads;

a conveying assembly for conveying the wrapped loads along a load path in a conveying direction;

a severing assembly including a severing element and means for moving the severing element between a pair of successive loads for severing the packaging material between the loads;

a breakaway mechanism for permitting the severing element to be displaced by a load in the conveying direction when the severing element is encountered by a load, and for permitting the severing element to be reset for subsequent operation.

18. The apparatus of claim 17 wherein the breakaway mechanism includes a pivot for permitting the severing element to pivot in the conveying direction.

19. The apparatus of claim 18 wherein the pivot has a generally horizontal pivot axis located above the load path.

20. A stretch wrapping apparatus comprising:

a stretch wrap dispenser for dispensing a web of stretch wrap packaging material on a load and means for providing relative rotation between the stretch wrap dispenser and a series of loads to wrap the stretch wrap packaging material around and between the series of loads;

a conveyor assembly for conveying the wrapped loads along a load path in a conveying direction, the conveyor assembly including a first conveyor portion having a discharge area and a second conveyor portion having a receiving area downstream and a step down from the discharge area of the first conveyor portion;

a severing assembly including a severing element located above the second conveyor portion and means for moving the severing element between a load positioned at an upper level in the discharge area of the first conveyor portion and a load positioned at a lower level in the receiving area of the second conveyor portion for severing the packaging material between the loads; and a breakaway mechanism for permitting the severing element to be displaced by a load in the conveying direction when the severing element is encountered by a load, and for permitting the severing element to be reset for subsequent operation.

21. The apparatus of claim 20 wherein the first conveyor portion is a load engaging portion of a first endless loop conveyor and the second conveyor portion is a load engaging portion of a second endless loop conveyor.

22. The apparatus of claim 20 wherein the breakaway mechanism includes a pivot for permitting the severing element to pivot in the conveying direction.

23. The apparatus of claim 22 wherein the pivot has a generally horizontal pivot axis located above the load path.

24. The apparatus of claim 15, 17 or 20 including a load sensor for detecting when the severing element encounters a load, and an escapement responsive to the load sensor for transporting the severing element to a position spaced from the load path when the severing element encounters a load.

25. The apparatus of claim 24 wherein the means for moving the severing element stalls when encountering a side of a load facing transverse to the load path and the load sensor senses this condition.

26. The apparatus of claim 24 wherein the load sensor senses when the severing element has been displaced by a side of a load facing the load path.

27. The apparatus of claim 15, 17 or 20 wherein the conveyor assembly includes means for transporting the first conveyor portion at a slower rate than the second conveyor portion to apply tension to the packaging material which extends between successive loads.

28. The apparatus of claim 15, 17 or 20 wherein the conveyor assembly includes a tacky surface which contacts the wrapped loads.

29. The apparatus as claimed in either of claims 1 or 15, wherein the severing assembly further includes means for translating the severing element in the conveying direction, said translating means operating in conjunction with said moving means.

30. A method for severing packaging material which extends between successive wrapped loads during a continuous packaging process comprising:

conveying the wrapped loads along a load path in a conveying direction;

severing the packaging material between the loads by moving a severing element between a pair of successive loads;

permitting the severing element to be displaced by a load in the conveying direction at times when the severing element is encountered by a load, and permitting the severing element to be reset for subsequent operation.

31. A method for severing packaging material which extends between successive wrapped loads during a continuous packaging process comprising:

conveying the wrapped loads along a load path in a conveying direction, including conveying the wrapped loads along a first conveyor portion having a discharge area and a second conveyor portion having a receiving area downstream and a step down from the discharge area of the first conveyor portion;

severing the packaging material between the loads by moving a severing element, located above the second conveyor portion, between a load positioned at an upper level in the discharge area of the first conveyor portion and a load positioned at a lower level in the receiving area of the second conveyor portion; and permitting the severing element to be displaced by a load in the conveying direction at times when the severing element is encountered by a load, and permitting the severing element to be reset for subsequent operation.

32. A method for severing packaging material which extends between successive wrapped loads during a continuous packaging process comprising:

conveying the wrapped loads along a load path in a conveying direction, including conveying the wrapped loads along a first conveyor portion having a discharge area and a second conveyor portion having a receiving area downstream and a step down from the discharge area of the first conveyor portion; and severing the packaging material between the loads by moving a severing element, located above the second conveyor portion, along a severing path which passes directly over the second conveyor portion and between a load positioned at an upper level in the discharge area of the first conveyor portion and a load positioned at a lower level in the receiving area of the second conveyor portion.

33. The method of claim 32, wherein the step of severing further includes the substep of translating the cutting element in the conveying direction at the same time as said moving of the severing element.

* * * * *